United States Patent [19]

Hooker

[11] 4,071,246

[45] Jan. 31, 1978

[54] MAGNETIC REEL READING DEVICE

[75] Inventor: Donald E. Hooker, Wilmette, Ill.

[73] Assignee: Bally Manufacturing Corporation, Chicago, Ill.

[21] Appl. No.: 715,525

[22] Filed: Aug. 18, 1976

[51] Int. Cl.[2] ..... A63F 5/04

[52] U.S. Cl. ..... 273/143 R; 235/92 EA

[58] Field of Search ..... 273/143 C, 143 R, 143 A, 273/143 B, 143 D, 143 E, 138 A, 138 R, 139; 235/92 EA, 92 C; 310/168, 111, 70 R, 155; 322/DIG. 5

[56] References Cited

U.S. PATENT DOCUMENTS

| | | | |
|---|---|---|---|
| 1,892,371 | 12/1932 | Tuczek | 310/168 UX |
| 2,026,329 | 12/1935 | Tauschek | 273/143 R UX |
| 2,110,144 | 3/1938 | Durkee et al. | 310/155 |
| 2,325,927 | 8/1943 | Wilbur | 310/168 X |
| 2,380,966 | 8/1945 | Iden | 310/168 |
| 2,580,270 | 12/1951 | Badgley et al. | 273/143 R UX |
| 3,258,550 | 6/1966 | Guetersloh et al. | 310/70 R X |
| 3,606,337 | 9/1971 | Larsen et al. | 273/143 R |
| 3,610,629 | 10/1971 | Pecksen | 273/143 R |
| 3,760,408 | 9/1973 | Maeda | 235/92 EA X |
| 4,011,476 | 3/1977 | Beard | 322/DIG.;5 |

FOREIGN PATENT DOCUMENTS

| | | | |
|---|---|---|---|
| 409,617 | 2/1971 | Australia | 273/138 A UX |
| 1,178,302 | 1/1970 | United Kingdom | 273/138 A |
| 1,233,363 | 5/1971 | United Kingdom | 273/143 R |
| 1,382,379 | 1/1975 | United Kingdom | 273/143 R |

*Primary Examiner*—William H. Grieb
*Assistant Examiner*—Arnold W. Kramer
*Attorney, Agent, or Firm*—Hill, Gross, Simpson, Van Santen, Steadman, Chiara & Simpson

[57] ABSTRACT

A game device comprising a plurality of reels which are rotated and stopped at random and in which each reel has different symbols arranged on its circumference and wherein the reel is made of magnetic material and is formed with openings such that one or more magnets mounted ajacent the reel will detect and produce an output that can be supplied to a counter so as to indicate the position where the reels stop and thus energize an output circuit. A second magnet mounted adjacent each reel can detect and produce an indexing output so as to reset the counter for each rotation of the reel. Additionally, a magnetic operated locking device for the reels are provided.

7 Claims, 5 Drawing Figures

MAGNETIC REEL READING DEVICE

BACKGROUND OF THE INVENTION

1. Field of the Invention

This invention relates in general to game devices which include a plurality of reels with indicia printed thereon such that various combinations of indicia on different reels produces a payout.

2. Description of the Prior Art

Gaming devices comprising a plurality of reels which are energized so as to cause them to spin and which include spring driven levers for rotating the reels and multinotched stop wheels in which switch actuating levers are received so as to indicate the stopping position have been well known in the art. Such mechanically actuated devices are fairly complex and expensive and the mechanical parts tend to wear out and render the machines inoperative.

SUMMARY OF THE INVENTION

The present invention relates to a gaming apparatus which has an object wherein one or more reels are rotated and stopped at random and wherein the reels each have different symbols displayed on their circumference at fixed intervals and which a particular symbol is displayed by each reel when they stop. The object of the present invention is to determine the angular position of one or more reels when they stop after being rotated and wherein the position is determined by sequential numbers assigned to each reel position such that if the reel has twenty positions each will be numbered from 0 to 19. At each position a particular symbol will be displayed and will have a number assigned to it and a counter is associated with each of the reels and is advanced one digit as each reel position passes a fixed point and the counter is reset after the last position. The output of the counter continuously indicates the numbered position of the reel and when the reel is stopped the output of the counter indicates the stopped position and thus which particular symbol is displayed by the reel.

The present invention comprises a method and apparatus of counting the reel positions as they pass a sensor.

In a particular embodiment, two sensors are mounted relative to the circumference of each reel which are made of a magnetic material as for example, metal such as steel and a plurality of holes are formed aligned with the first sensor and a single hole is formed aligned with the second sensor such that the reluctance of the magnetic circuit of magnetic sensors changes as each hole passes the sensor and this change in magnetic flux is detected by the magnetic sensors and results in a voltage pulse appearing at the output of the magnetic sensor. Each hole passes the sensor half-way between the display of a particular symbol and a display of the next symbol.

The second sensor is connected to the counters so as to reset it to zero and the first magnetic sensor causes the counter to advance one count as each hole in the circumference of the reel passes and thus the counter continually records the position of the reel. The reels are covered with paper or plastic upon which indicia is printed and which has non-magnetic properties so as to display the symbols.

A payout circuit is connected to the output of the counters for the various reels through suitable logic circuitry such that the payout circuit is energized upon the preselected combinations.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
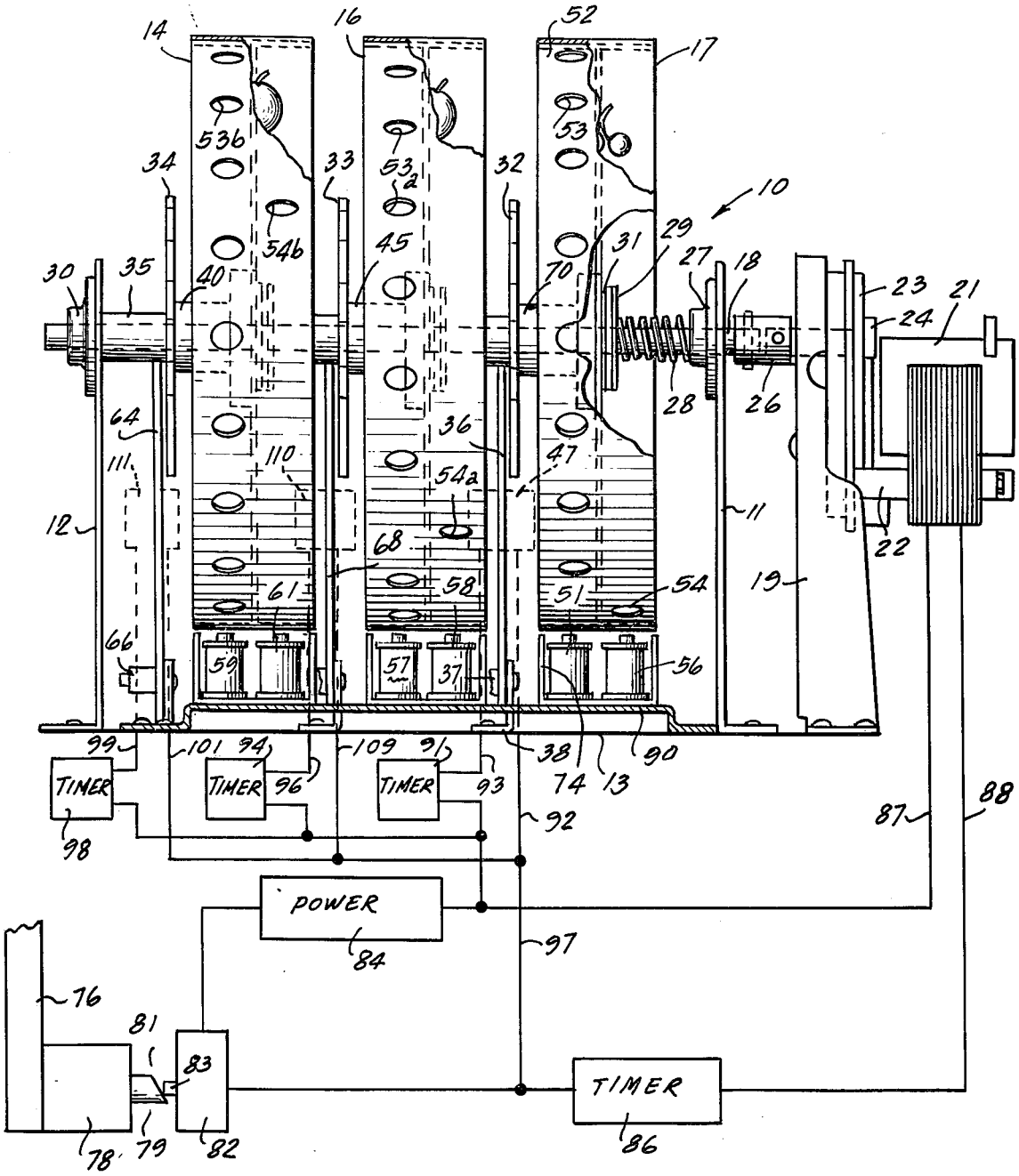
FIG. 1 is a plan view of the invention.

FIG. 1 illustrates the gaming machine of the invention which includes a plurality of rotatably supported reels 14, 16 and 17 that carry thereon a number of indicia or symbols such that certain combinations when visible through display windows not shown are winning combinations.

Figure 2:
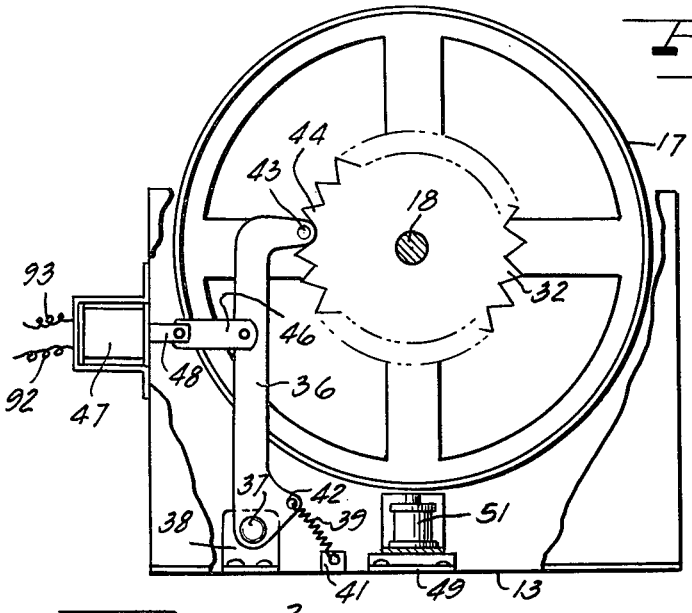
FIG. 2 is a side view of the invention illustrating one of the reels.

FIG. 1 illustrates the invention with the cover removed comprising side frame members 11 and 12 attached to a base 13 and a driving shaft 18 is supported by the side members 11 and 12 and rotatably supports reels 14, 16 and 17. A hub 30 prevents the shaft 18 from moving transversely of the side member 12 and a spacer hollow cylindrical member 35 is mounted between the side member 12 and a tooth detent plate 34 which is connected by hub 40 to reel 14. A pawl 64 is engageable with the detent member 34 and is pivotally supported from shaft 66 connected to the base 13 of the machine. A second detent wheel 33 is connected by a hub 45 to reel 16 and pawl 68 is engageable therewith to stop reel 16. A pawl 36 as shown in FIG. 2, is pivotally connected to bracket 38 by pivot pin 37 which is connected to base plate 13. Hub 70 connects the detent plate 32 to the reel 17.

A motor 21 is connected to an upright frame member 19 and has an output shaft 22 which supplies an input to a gear reduction 23 which has an output shaft 24 which is coupled by coupling means 26 to the shaft 18. A friction disk 31 is connected to reel 17 and friction disk 29 bears against disk 31 and is connected by a spring 28 to shaft 18 so that it rotates with shaft 18. Each of the reels 16 and 14 have friction disks similar to disk 31 and mate with driven friction disk similar to disk 29 which is driven by shaft 18 when the motor 21 is energized.

Each of the reels 14, 16 and 17 are formed with a plurality of aligned openings such as openings 53 which are formed in the left half relative to FIG. 1 of reel 17 and the openings 53 correspond to the number of symbols or indicia on the reel 17 and are formed in the left portion of the reel 17. The reels 14, 16 and 17 are made of a suitable magnetic material such as metal such that the openings 53 can be detected by a magnetic detector such as the magnet 51 which is mounted on a bracket 90 connected to the base plate 13. An opening 54 is also formed in the disk 17 in the right portion relative to FIG. 1 and corresponding openings **54*a* and 54*b* are formed in the right portions of disks 16 and 14** respectively.

Magnetic detecting means 59, 57 and 51 are aligned respectively with the left portions of reels 14, 16 and 17 so as to detect the position relative to the openings 53, 53*a* and 53*b* in the left portions of the reels 17, 16 and 14 and magnetic detectors 56, 58 and 61 are mounted relative to the right side of the reels 17, 16 and 14 so as to detect the openings 54, 54*a* and 54*b*, respectively.

As shown in FIG. 2, the detent wheel 32 which is connected to reel 17 has teeth 44 which are engageable with a roller 43 mounted on pawl 36. A relay 47 has an armature 48 that is connected to a link 46 that is connected to pawl 36 such that when the relay 47 is energized by leads 92 and 93 the armature 48 moves to the left relative to FIG. 2 moving the roller 43 out of the teeth 44 of the detent wheel 32 so that the reel 17 can be rotated by the motor 21. A spring 39 is connected between bracket 41 connected to base plate 13 and portion 42 of pawl 36 to spring bias the pawl 36 into engagement with the teeth 44.

Figure 3:
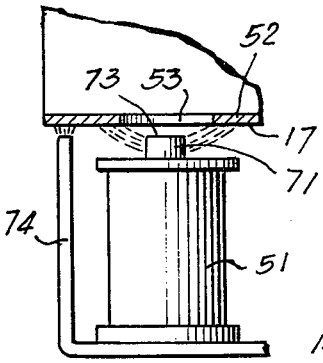
FIG. 3 illustrates one of the detector magnets aligned with an opening in a reel.
Figure 4:
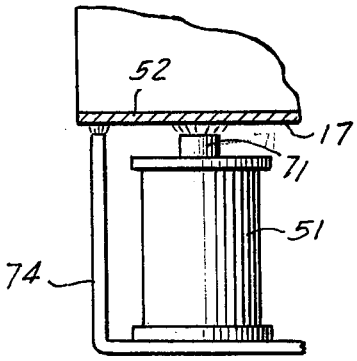
FIG. 4 illustrates one of the detector magnets out of alignment with an opening in the reel.

FIG. 3 is a partially cut-away sectional view of reel 17 and illustrates the metal cylindrical portion 52 of the reel and an opening 53 formed therein. A detecting magnet 51 has a permanent magnet 71 surrounded by detector winding with one end 73 mounted adjacent the reel 17. FIG. 4 illustrates the reel and detector 51 in a position such that the opening 53 is not adjacent the end 73 of the magnet 71. The flux path of the magnet 71 passes through the reel surface 52 as shown in FIG. 4 when the opening 53 is not adjacent the end 73 of the magnet but the reluctance of the magnetic path is substantially increased when the opening 53 moves so that it is adjacent the end 73 of the magnet as shown in FIG. 3. As this occurs, the output winding of the detector 51 will produce an output pulse due to the change in flux and such output pulse can be detected and counted by a suitable counting means so as to indicate the position of the reels to the magnetic detectors. An L-shaped arm 74 shortens the magnetic path of detector 51.

FIG. 1 also illustrates the electrical schematic for the invention and includes an actuating lever 76 which is connected to a locking means 78 that is released by the depositing of a suitable coin into the machine so as to allow the lever 76 to be moved and upon such deposit of a suitable coin the lever 76 can be rotated to move cam 79 so that the cam surface 81 closes the switch contact 83 of a switch 82 to energize the machine. When the lever 76 is rotated, the cam surface 81 closes the switch contact 83 which has one side connected to power source 84 and the other side connected to a first timer 86 that is connected to lead 88 of motor 21. The other lead 87 of motor 21 is connected to the second side of power source 84 and thus when the switch 82 is closed power is supplied through timer 86 to the motor 21 which is energized to drive shaft 18 and the reels 17, 16 and 14 through the friction disk such as disks 29 and 31 illustrated on reel 17.

Simultaneously, when switch 82 is closed power is applied to pawl relays 47, 110 and 111 through timers 91, 94 and 98 and leads 92, 93, 96, 109 and 99 and 101. The timers 91, 94 and 98 may have different timing out times and as a particular timer times out it interrupts power to the pawl holding relays 47, 110 and 111 such that they release the pawls 36, 68 and 64 to allow the pawls to stop its associated reels 17, 16 and 14 in a particular angular position. The timer 86 de-energizes the motor 21.

Figure 5:
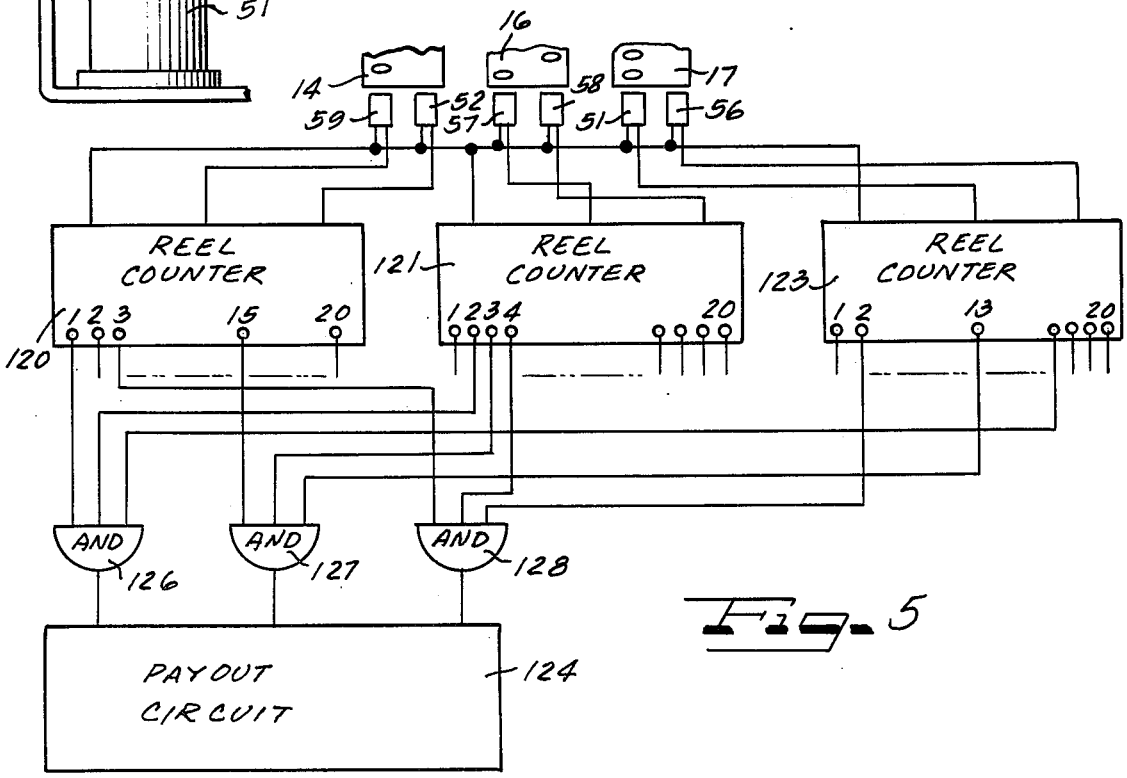
FIG. 5 illustrates the electrical schematic of the invention.

FIG. 5 illustrates the pay-out circuit and comprises three counter circuits 120, 121 and 123 which respectively receive inputs from reels 14, 16 and 17. The magnetic detectors 59 and 52 are connected to reel counter 120, the magnetic detectors 57 and 58 are connected to reel counter 121 and the magnetic detectors 51 and 56 are connected to the reel counter 123. The magnetic detectors 52, 58 and 56 are connected to the reset terminals of the counters 120, 121 and 123, respectively, and the detectors 59, 57 and 51 are connected to the step up counting terminals of the counters 120, 121 and 123.

A pay-out circuit 124 receives inputs from logic circuits as for example, AND gates 126, 127 and 128 such that when any one of the AND gates is energized the pay-out circuit will be energized depending upon which AND gate is energized to pay out different premiums. For example, the AND gate 126 may receive an input from the first counting position of counter 120 and a second input from the second counting position of reel counter 121 and the 17th position from reel counter 123. When the reels 14, 16 and 17 stop in these positions the AND gate 126 will be enabled to supply an output to the payout circuit 124 which will cause it to dispense the proper amount for the particular winning combination.

The AND gate 127 might be connected to the 15th counting position of counter 120, the third counter position of counter 121 and the 13th counter position of counter 123 and when the reels 14, 16 and 17 stop in this position the AND gate 127 will be enabled and actuate the pay-out circuit 124. The AND gate 128 may receive an input from the third counting position of counter 120, an input from the fourth counter position of counter 121 and an input from the second counter position of counter 123. When the reels stop in these positions the AND gate 128 will be enabled to energize the pay out circuit 124.

It is to be realized, of course, that suitable paper or plastic indicia is attached to the surfaces of the reels 14, 16 and 17 so that such indicia is visible through a viewing window for the operator and such material is nonmagnetic and thus does not interfere with the magnetic detection of the openings in the reels 14, 16 and 17.

Although it has been described with respect to preferred embodiments, it is not to be so limited, as changes and modifications may be made which are within the full intended scope as defined by the appended claims.

I claim as my invention:

1. Means for detecting the position of a reel having a portion of magnetic material in an outer cylindrical rim portion with a first plurality of aligned openings formed in said magnetic material and circumferentially spaced about the rim portion, comprising, a first magnetic detector mounted adjacent said openings in said magnetic material such that an output pulse is produced each time an opening passes said detector, a counting means receiving the output of said first magnetic detector, an indexing opening formed in the magnetic material in said reel offset from said first plurality of openings, a second magnetic detector mounted adjacent said reel, an indexing pulse produced each time said indexing opening passes said second magnetic detector, the output of said second magnetic detector being connected to a reset terminal of said counting means, and said cylindrical rim being of magnetic material and said first plurality of openings and said indexing opening being formed in said rim.

2. Means for detecting according to claim 1 wherein said first and second magnetic detectors comprise first and second permanent magnets with first ends mounted so that said first plurality of openings and said indexing opening move therepast and detecting coils wound about said first and second permanent magnets to produce said output pulses as said reel moves relative to said permanent magnets.

3. Means for detecting the position of a reel according to claim 2 including means for driving said reel and detent means for stopping said reel at an indexed position.

4. An amusement machine comprising:

a frame member, at least first and second reels rotatably supported by said frame and at least an outer circumferential rim portion of each formed of magnetic material, means for intermittently driving said reels such that they stop at random positions, a first pair of magnetic detectors mounted on said frame adjacent said first one of said reels, a first plurality of openings formed and circumferentially spaced and aligned in the magnetic portion of said first reel and positioned so as to be aligned with said first one of said first pair of magnetic detectors to detect a discrete position of said first reel, a first indexing opening formed in the magnetic portion of said first reel offset from said first plurality of openings and aligned with a second one of said first pair of magnetic detectors, a first counter connected to the first pair of magnetic detectors with the first one connected to the up-counting input of said first counter and the second one connected to the reset input of said first counter, an output pulse being produced by the magnetic detectors when an opening passes the detectors, a second pair of magnetic detectors mounted on said frame adjacent said second reel, a second plurality of openings formed and circumferentially spaced and aligned in the magnetic portion of said second reel and positioned so as to be aligned with a first one of said second pair of magnetic detectors to detect a discrete position of said second reel, a second indexing opening formed in the magnetic portion of said second reel offset from said second plurality of openings and aligned with a second one of said second magnetic detectors, a second counter connected to the second pair of magnetic detectors with the first one connected to the up-counting input of said second counter and the second one connected to the reset input of said second counter, an output pulse being produced by the magnetic detectors when an opening passes the detectors, a pay out circuit, first and second AND gates supplying inputs to said pay out circuit, certain selected outputs of said first and second counters connected to said first and second AND gates which are enabled such that said pay out circuit is actuated on certain preset positions of said first and second reels when said first and second reels come to rest at discrete positions, and indexing means for said first and second reels such that they stop at discrete positions.

5. An amusement device according to claim 4 including a third reel formed with a third plurality of circumferentially spaced and aligned openings and a third indexing opening offset from said third plurality of openings a third pair of magnetic detectors mounted on the frame adjacent said third plurality of openings and said third indexing opening, a third counter with its up-counting input connected to the first one of said third pair of magnetic detectors and its reset input connected to the second one of said third pair of magnetic detectors, a third AND gate connected to said pay out circuit, and certain selected outputs of said first, second and third counters connected to said third AND gate, and certain outputs of said third counter connected to said first and second AND gates.

6. An amusement device according to claim 5 wherein said first, second and third pair of magnetic detectors are permanent magnets with detecting coils wound thereabout.

7. An amusement device according to claim 6 wherein said first, second and third plurality of openings and said first, second and third indexing openings are formed in rims of said first, second and third reels.

* * * * *